US007748540B2

(12) United States Patent
Matsumoto et al.

(10) Patent No.: US 7,748,540 B2
(45) Date of Patent: Jul. 6, 2010

(54) PALLET PACKING TOOL

(75) Inventors: Juusei Matsumoto, Tokyo (JP); Tomoaki Arai, Tokyo (JP); Satoshi Ishihara, Saitama (JP); Sakae Ishikawa, Kanagawa (JP); Takefumi Adachi, Saitama (JP); Hisao Chikano, Kanagawa (JP); Satoshi Kitaoka, Tokyo (JP); Junichi Murano, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 839 days.

(21) Appl. No.: 11/448,885

(22) Filed: Jun. 8, 2006

(65) Prior Publication Data

US 2006/0226046 A1 Oct. 12, 2006

Related U.S. Application Data

(62) Division of application No. 10/743,865, filed on Dec. 24, 2003, now Pat. No. 7,222,471.

(30) Foreign Application Priority Data

Dec. 26, 2002 (JP) ..... 2002-377417

(51) Int. Cl.
*B65D 19/00* (2006.01)

(52) U.S. Cl. ..... 206/597; 206/386; 108/55.1; 108/55.5

(58) Field of Classification Search ..... 206/319, 206/320, 386, 597, 600; 108/55.1, 55.3, 108/55.5; 410/46, 100, 103
See application file for complete search history.

(56) References Cited

U.S. PATENT DOCUMENTS 3,704,673 A * 12/1972 Drelicharz ..... 108/53.3
4,018,154 A 4/1977 Matsumoto et al.
4,050,604 A * 9/1977 Flanders ..... 220/4.28
4,801,981 A 1/1989 Chikano et al.
4,866,482 A 9/1989 Hirasawa et al.
4,942,434 A 7/1990 Nakai et al.
5,087,932 A 2/1992 Chikano
5,255,060 A 10/1993 Chikano
5,594,539 A 1/1997 Murano et al.
5,642,830 A * 7/1997 Foster ..... 220/4.28
5,694,638 A 12/1997 Maruyama et al.
6,109,846 A * 8/2000 Davis et al. ..... 410/100
6,216,607 B1 * 4/2001 Cuddy ..... 108/55.5

(Continued)

FOREIGN PATENT DOCUMENTS

JP 01009157 A * 1/1989

(Continued)

OTHER PUBLICATIONS

U.S. Appl. No. 12/261,651, filed Oct. 30, 2008, Kitaoka.

*Primary Examiner*—David T Fidei
(74) *Attorney, Agent, or Firm*—Oblon, Spivak, McClelland, Maier & Neustadt, L.L.P.

(57) ABSTRACT

A packing tool for packing large articles such as image forming apparatuses has a pallet to place the article, and an article-fixing member to secure the article to the pallet. The article-fixing member is accommodated in an accommodating section in the pallet. When securing the article to the pallet, the article-fixing member is pulled out and wound around the article.

7 Claims, 5 Drawing Sheets

U.S. PATENT DOCUMENTS

| | | | | |
|---|---|---|---|---|
| 6,293,400 | B1 | 9/2001 | Aria et al. | |
| 6,343,555 | B1 | 2/2002 | Arai et al. | |
| 6,357,063 | B1 * | 3/2002 | Selby | 5/81.1 R |
| 6,422,407 | B2 | 7/2002 | Arai | |
| 6,463,863 | B1 | 10/2002 | Ishikawa et al. | |
| 6,554,300 | B1 * | 4/2003 | Ziolkowski | 280/47.27 |
| 6,602,032 | B2 * | 8/2003 | Arai | 410/46 |
| 6,701,104 | B2 | 3/2004 | Chikano | |
| 2002/0008048 | A1 | 1/2002 | Ishikawa et al. | |

FOREIGN PATENT DOCUMENTS

| | | |
|---|---|---|
| JP | 5-3129 | 1/1993 |
| JP | 5-49629 | 6/1993 |
| JP | 10-167267 | 6/1998 |
| JP | 2001-151234 | 6/2001 |
| JP | 2001-315777 | 11/2001 |
| JP | 2002-179060 | 6/2002 |
| JP | 337944 | 11/2002 |
| JP | 252343 | 9/2004 |
| JP | 14992 | 1/2005 |
| JP | 43584 | 2/2005 |
| JP | 54978 | 3/2005 |
| JP | 154007 | 6/2005 |

* cited by examiner

PALLET PACKING TOOL

CROSS-REFERENCE TO RELATED APPLICATIONS

This application is a division of application Ser. No. 10/743,865, filed on Dec. 24, 2003, which claims priority to Japanese application No. JP 2002-377417 (now JP 2004-203463), filed in Japan on Dec. 26, 2002, the entire contents of each of which are incorporated herein by reference.

BACKGROUND OF THE INVENTION

1) Field of the Invention

The present invention relates a packing method and a packing tool used in the packing method.

2) Description of the Related Art

Corrugated boxes are well known packing materials. However, although the corrugated boxes are suitable for packing relatively small articles they are not suitable for packing big articles. The image forming apparatuses such as the color printers, copiers are originally bulky; moreover, sometimes an additional paper feeder bank is provided with them for housing large amount of paper which makes them more bulky. Therefore, the corrugated boxes are not suitable for packing the image forming apparatuses.

Large articles are generally packed using pallets. A pallet includes, for example, a rectangular base and four posts at the four corners of the base and a ceiling plate. The article is placed on the base in the space guided by the posts and the ceiling plate. A related technology has been disclosed in Japanese Patent Application Laid-open No. 2002-179060 (Paragraph [0018] and FIG. 1).

Recycling of used objects has been desired, and the packing material is no exception. After the article is unpacked, the base and the posts of the pallet are disassembled and stored at one place so that they can be reused. The posts are bundled together so that they remain together and take lesser storage space. This enables better management and also prevents loss of the posts. A related technology has been disclosed in Japanese Patent Application Laid-open No. 2001-315777.

The article to be packed placed on the pallet and accommodated in a space between the pallet and the posts and possibly an upper lid. If the article is small and there is extra space, it is necessary to fill something around the article so that the article does not move. Foam is generally used for such purpose. Sometimes the article is tied with a band. However, either the foam or the band is required to firmly hold the article. Moreover, the articles are of varying sizes so that foams or band of varying proportions are required which leads to an increase in the cost. Moreover, a slope plate is required to unload the article that has been unpacked from the pallet.

The packed articles are stored in a warehouse before they are transported. In a warehouse, generally the packed particles are stacked above one another to use space effectively. However, image forming apparatuses can not be packed in this manner; because they may get damaged. Therefore, for stacking the image forming apparatuses, shelves having many tires are used.

Some of the image forming apparatuses have an automatic document feeder on the top side. There is a possibility that the automatic document feeder hit against the upper lid and get damaged. Therefore, the automatic document feeder is covered with a packing material from above when the image forming apparatus is packed. Sometimes a band is also wound around the sheet surface to fix the feeder in some cases.

The conventional packing methods require different packing material; moreover, an appropriate strength with which the band should be tied needs to be adjusted. If the band is tied weakly, the article may move and get damaged, if the band is tied tightly, the article may break.

SUMMARY OF THE INVENTION

It is an object of the present invention to solve at least the problems in the conventional technology.

A packing method according to one aspect of the present invention includes using a pallet on which an article to be packed can be placed, and an article-fixing member which fixes the article on the pallet. The article-fixing member is accommodated in the pallet such that the article-fixing member can be pulled out when the article is to be packed and is wound around the article to firmly fix the article on the pallet.

A packing tool according to another aspect of the present invention includes a pallet to place an article; an article-fixing member accommodated in an accommodating section provided in the pallet such that the article-fixing member can be pulled out from the accommodating section; and a plurality of posts mounted on the pallet. A length of the article-fixing member is adjusted in accordance with a height and a size of the article, and the article-fixing member pushes the article against the pallet in the vertical direction.

The other objects, features and advantages of the present invention are specifically set forth in or will become apparent from the following detailed descriptions of the invention when read in conjunction with the accompanying drawings.

DETAILED DESCRIPTION

Exemplary embodiments of a packing tool according to the present invention will be explained below with reference to the accompanying drawings.

Figure 1:
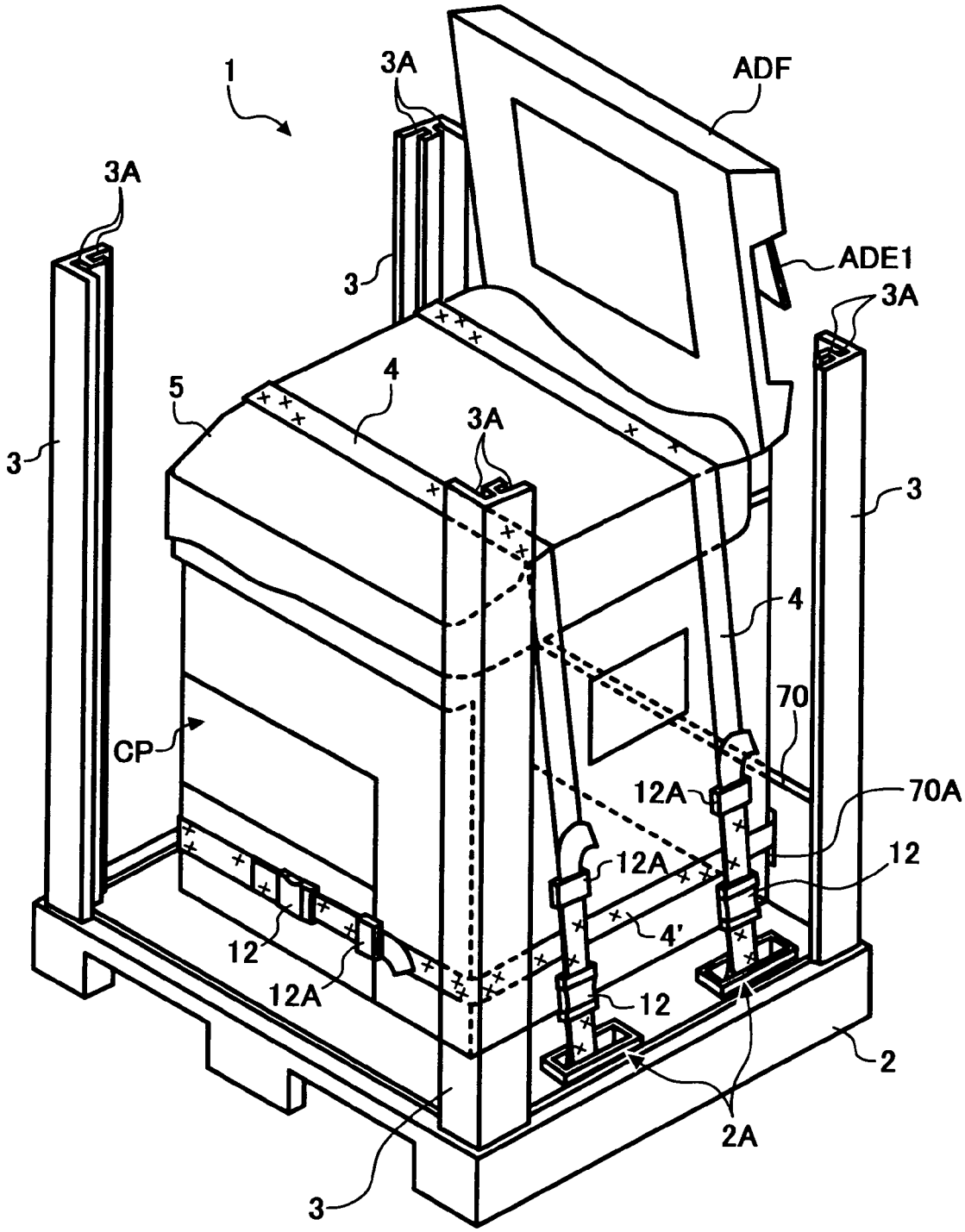
FIG. 1 is a packing tool according to an embodiment of the present invention.

FIG. 1 is a packing tool according to an embodiment of the present invention. This packing tool 1 may be used to pack and transport image forming apparatuses CP, such as printers or copiers, having an automatic document feeder ADF provided at the top.

Figure 3:
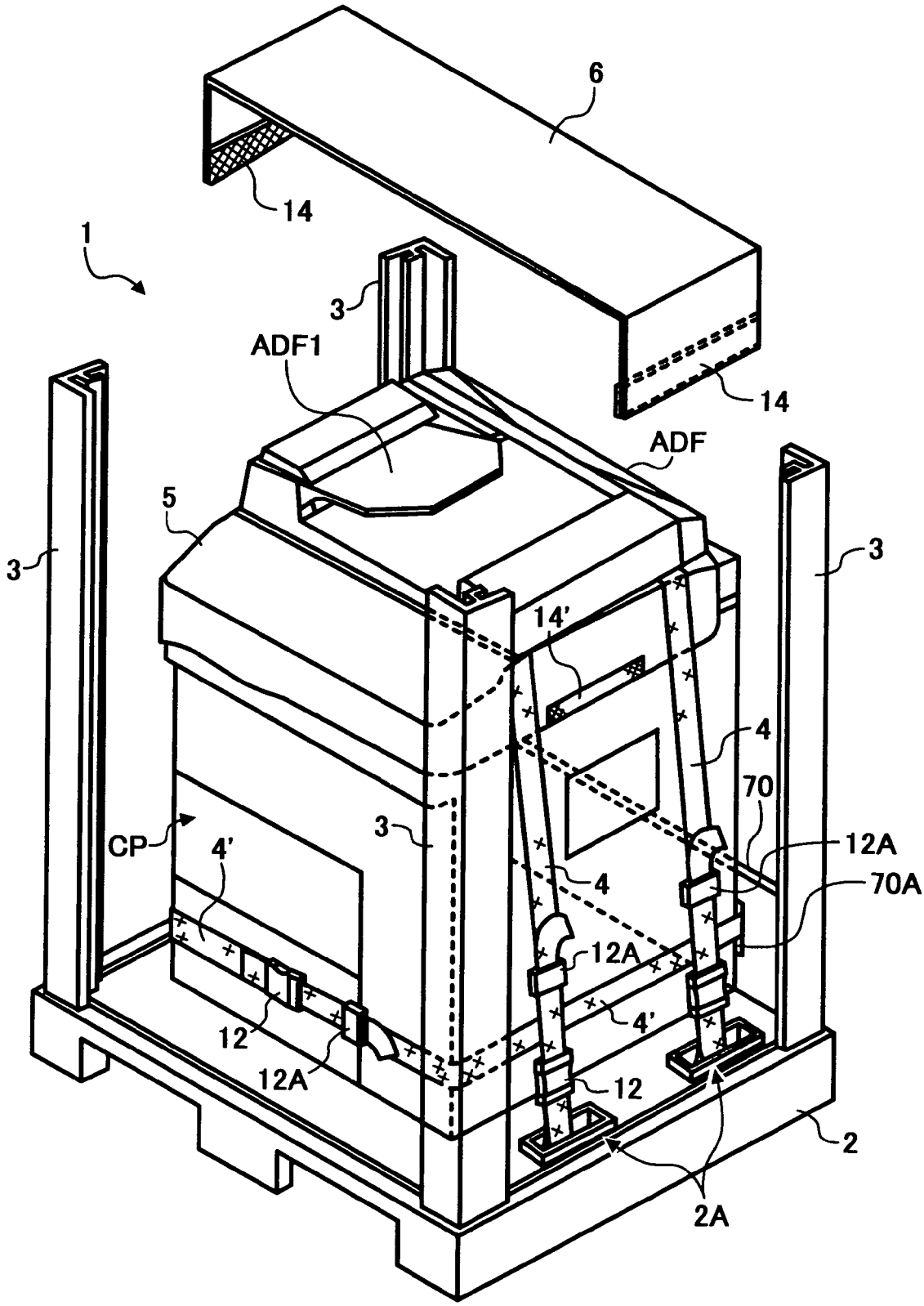
FIG. 3 is to explain how an article is packed with the packing tool.
Figure 4:
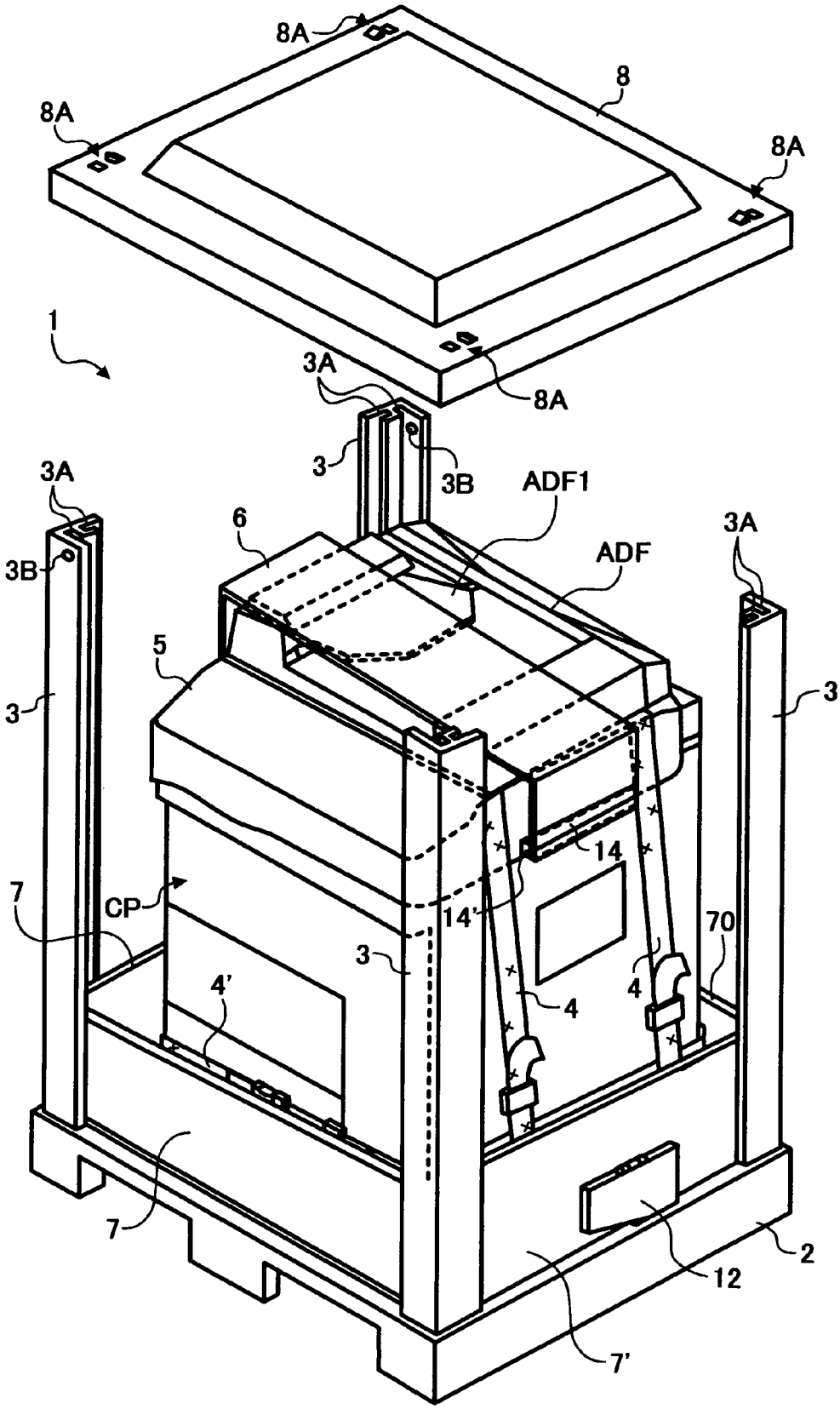
FIG. 4 is to explain how an article is packed with the packing tool.

As shown in FIGS. 1, 3 and 4, the packing tool 1 includes a pallet 2 which constitutes a bottom plate and on which the image forming apparatus CP is placed, posts 3 which stand from corners of the pallet 2, bands 4 and 4' correspond to an article-fixing member mounted on the pallet 2, a sheet material 5 provided on an upper surface of the image forming apparatus CP and covering a document table (not shown) having an automatic document feeder ADF which can be opened and closed, a covering member 6 (see FIG. 3) capable of covering an upper portion of the automatic document feeder ADF which is closed in a state in which the covering member 6 covers the document table, a surface plates 7 (see FIG. 4) mounted between the posts 3 and respectively located on a front surface, a back surface and opposite side surfaces, and a ceiling plate 8 (see FIG. 4) which can be mounted on upper surfaces of the posts 3.

The pallet 2 is provided with two accommodating sections 2A for the bands 4 which are wound around the image forming apparatus CP in the vertical direction. The accommodating sections 2A are located close to lower portions of sidewalls of the image forming apparatus CP along the depth direction on the opposite sides in the width direction of the image forming apparatus CP. A configuration of the accommodating sections 2A is shown in FIGS. 2A and 2B.

Figure 2A:
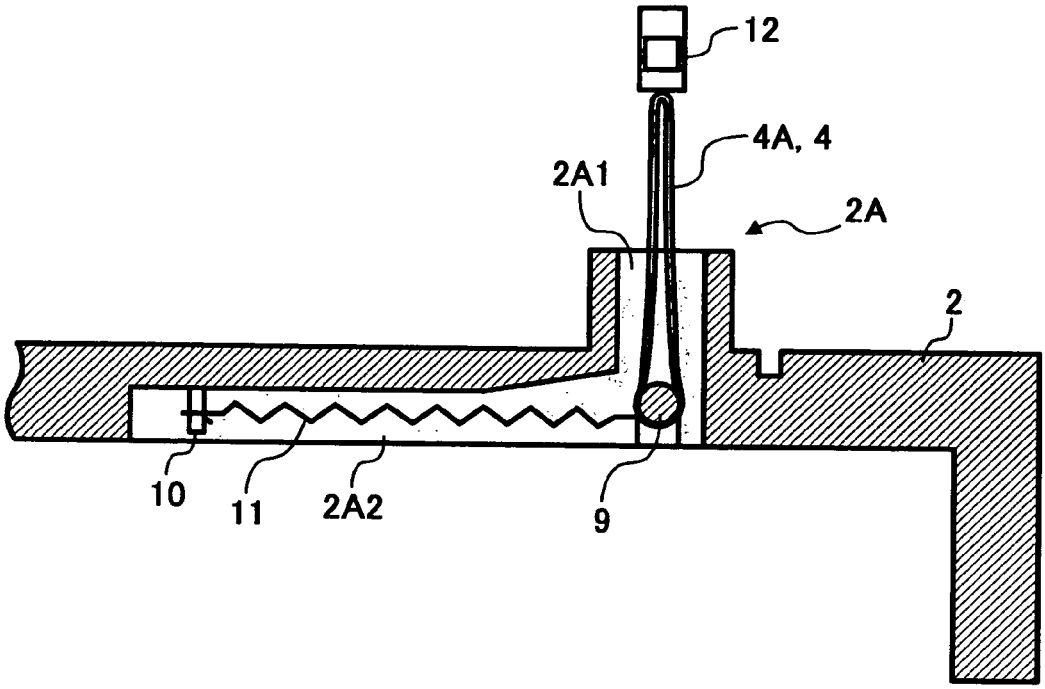
FIG. 2A and FIG. 2B are sectional views of an accommodating section in the packing tool.
Figure 2B:
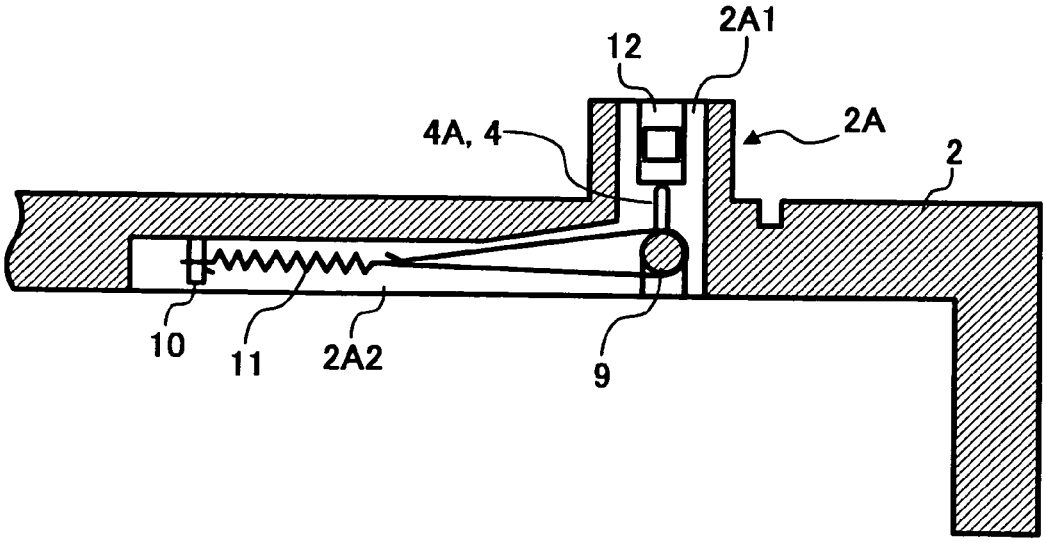

In FIG. 2A, each of the accommodating sections 2A include an opening 2A1 formed in the pallet 2, and an accommodating space 2A2 which is continuous with the opening 2A1. A support rod 9 is fixed at a position where the accommodating space 2A2 and the opening 2A1 intersect with each other. The support rod 9 is inserted into an end 4A of the band 4 which bypasses in a form of a loop.

A support pin 10 is fixed to the accommodating space 2A2 at a position for from the intersecting position. One end of a spring 11 is fixed to the support pin 10, and the other end is fixed to the end 4A of the band 4. Normally, the end 4A has such properties that one end and the other end (only one end is illustrated in FIGS. 1, 3 and 4) of a coupler member 12 constituting a coupling member connected to the end 4A are normally pulled toward the accommodating section 2A. For this reason, when the article is packed, i.e., when the band 4 is not wound around the image forming apparatus CP in the vertical direction, the one end and the other end of the coupler member 12 are pulled into and accommodated in the accommodating sections 2A as shown in FIG. 2B. Although only the side accommodating sections 2A on the one side of the image forming apparatus CP in its width direction are shown in FIGS. 1, 3 and 4, the bands 4 have the same configuration also in the accommodating sections (not shown) on the other side in the width direction.

The one end of each of the bands 4 is provided with a ring-like retaining member 12A (FIG. 1). When the band 4 is wound around the image forming apparatus CP and is stretched, the one end is folded back from the coupler member 12 and a remained portion of the end of the band 4 is held by the ring-like retaining member 12A. FIG. 2A illustrates a state in which the band 4 is pulled out from its accommodated state shown in FIG. 2B. There also exists a band 4' which is wound around the image forming apparatus CP in the horizontal direction. The band 4' is also provided with a coupler member 12 and a ring-like retaining member 12A.

The post 3 is a mold made of aluminum or other material. The post 3 is formed at its cross section with a fitting groove 3A which is cut in a direction at right angles to each other as viewed from above. As shown in FIG. 4, the surface plates 7 which are opposed to the front surface, the back surface and the opposite side surfaces of the image forming apparatus CP are press-fitted into the fitting grooves 3A.

Each the surface plate 7 is a flat surface plate made of synthetic resin, plate metal or plate material. The surface plates 7 prevent the posts 3 from falling. The height of the surface plate 7 is set lower than the height of the image forming apparatus CP which is an article to be packed.

Each the surface plate 7 is press-fitted into the fitting grooves 3A and lies between the posts 3, and the inside of the packing tool is in communication with outside of the packing tool through space above the surface plate 7. Thus, only a bottom portion of the image forming apparatus CP which is the article to be packed is hidden by the surface plates 7, but its upper portion is exposed to outside.

As shown in FIG. 4, a leg 12 is mounted, in a hinge manner, to one surface plate 7' of the surface plates 7 which is opposed to one of the sidewalls of the image forming apparatus CP such that the leg 12 can fall and stand.

Figure 5:
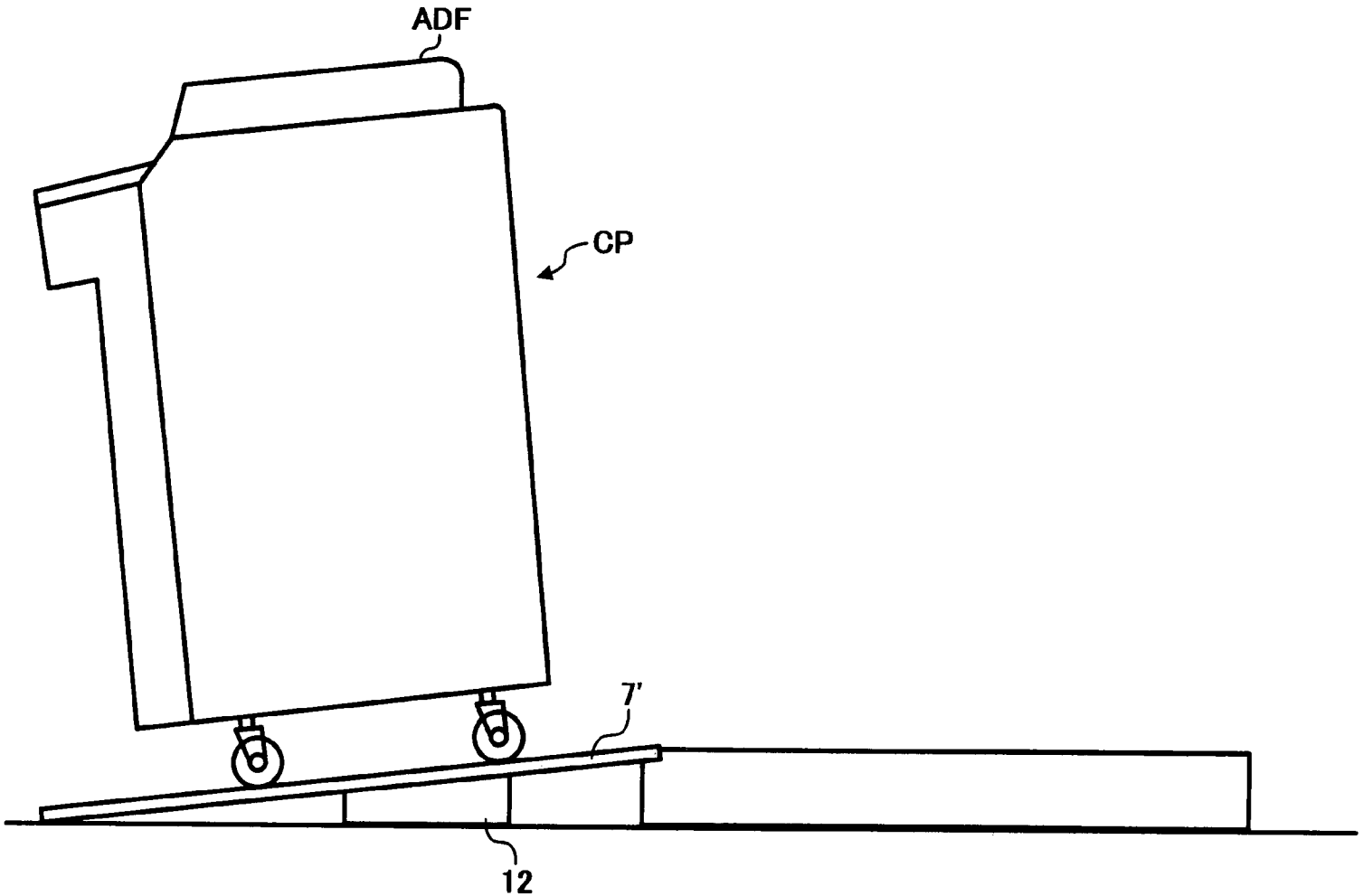
FIG. 5 is to explain how a surface plate is used.

When the leg 12 falls, the leg 12 is hung to a surface of the surface plates 7' by a latch mechanism provided between the leg 12 and the surface plate 7'. If the leg 12 is allowed to stand up from this state, the surface plate 7' can be used as a slope plate (SP in FIG. 5) when the image forming apparatus CP which is the packed article is unloaded as shown in FIG. 5.

As shown in FIGS. 1 and 3, one surface plate (shown with a symbol 70 in FIGS. 1 and 3) of the surface plates 7 which is opposed to the back surface of the image forming apparatus CP is formed with a pair of insertion holes 70A along the horizontal direction. The band 4' which is wound around the image forming apparatus CP in the horizontal direction passes through the insertion holes 70A. The band 4' is accommodated in an accommodating section (not shown) which is different from the accommodating sections which accommodate the band 4. Instead of accommodating the band, the band may be wound between the insertion holes 70A and may be mounted on the packing tool 1.

The surface plate 70 is fitted into the posts 3 before other surface plates 7 are fitted because the band 4' is wound around the image forming apparatus CP in the horizontal direction.

A cloth is used as the sheet material 5. The sheet material 5 has such a size that the sheet material 5 can cover the document table of the image forming apparatus CP. Four sides of the sheet material 5 trail in accordance with the size of the document table so that an area for covering the document table can be changed in accordance with the size of the document table. The sheet material 5 is integrally sewed together with the band 4 which is hung from the upper surface of the sheet material 5.

Instead of integrally sewing the sheet material 5 and the band 4 together, a tunnel through which the band 4 can slide may be formed in the upper surface of the sheet material 5 such that the band 4 can relatively move. The reason why the band 4 and the sheet material 5 are arranged such that they can relatively move is as follows:

When the band 4 is stretched in accordance with the height of the image forming apparatus CP, if the band 4 and the sheet material 5 are integrally formed, a position of the sheet material 5 may be deviated with respect to a position of the document table in some cases, but if the band 4 relatively moves in a state in which the sheet material 5 is aligned with the position of the document table, the sheet material 5 can be fixed to the position of the document table.

The covering member 6 has a shape capable of covering an upper portion of the automatic document feeder ADF, i.e., a downwardly oriented channel shape as viewed from front, and detachable joint members 14 are integrally attached to inner surfaces of lower ends of the hanging sides. Joint members 14' (FIG. 3) are also attached to outer surfaces of lower ends of the hanging sides of the sheet material 5. These joint members 14, 14' can be stuck and detached so that the sheet material 5 and the covering member 6 can be attached to and detached from each other.

The covering member 6 is mounted on the sheet material 5 such that the flat surface section of the covering member 6 is located at an upper position where it does not come into contact with a document catch tray ADF1 which stands on the automatic document feeder ADF. In this state, it is possible to prevent from the automatic document feeder ADF from being damaged by disturbance.

The ceiling plate 8 mounted on the upper surfaces of the posts 3 has engaging pins 8A having properties to be engaged with engaging holes 3B formed in the posts 3. The ceiling plate 8 is fixed by engaging the engaging pins 8A into the engaging holes 3B. The pallet 2 can be placed on an upper surface of the ceiling plate 8, and the packing tool 1 can be stacked.

The image forming apparatus CP is packed in the packing tool in the following manner.

The image forming apparatus CP is placed on the pallet 2. The image forming apparatus CP may have casters so that the image forming apparatus CP can be slided, the casters are not necessary.

(1) The automatic document feeder ADF of the image forming apparatus CP is opened, and the document table located at a lower portion of the automatic document feeder ADF is covered with the sheet material 5.

(2) The bands 4 which are previously accommodated in the accommodating sections 2A of the pallet 2 are pulled out, and are wound around the image forming apparatus CP in the vertical direction. Ends of the bands are coupled to the coupler member 12, the bands are stretched so that the image forming apparatus CP is pushed in the vertical direction. The stretched and folded back bands 4 are holed by the ring-like retaining members 12A and tightened states of the bands are maintained.

(3) At that time, in order to set the surface plate 70 on the back surface side of the image forming apparatus CP such that the surface plate 70 is opposed to the back surface of the image forming apparatus CP, the posts 3 between which the surface plate 70 is fitted is set up. With this, the band 4' which passes through the insertion hole 70A of the surface plate 70 which is opposed to the back surface of the image forming apparatus CP is wound around the image forming apparatus CP in the horizontal direction and stretched, and the image forming apparatus CP is pushed toward the surface plate 70 and is fixed.

A state in which the procedures (1) to (3) are carried out is shown in FIG. 1. In this state, the image forming apparatus CP is pushed against the pallet 2 in the vertical direction and is pushed against the surface plate 70 and fixed. Therefore, it is unnecessary to embed a cushioning to fix the image forming apparatus CP.

(4) The automatic document feeder ADF is put on the upper surface of the sheet material 4 which covers the document table and the automatic document feeder ADF is closed. This state is illustrated in FIG. 3. The automatic document feeder ADF is maintained in a state in which the feeder does not receive a load from the band 4.

(5) In the state illustrated in FIG. 3, the covering member 6 covers the upper portion of the automatic document feeder ADF. With this configuration, the automatic document feeder ADF can not be opened and this state is maintained.

The covering member 6 is positioned such that its flat surface does not come into contact of the document catch tray ADF1 of the automatic document feeder ADF. In this state, the joint members 14 are joined to the joint members 14' on the side of the sheet material 5. With this configuration, the position of the covering member 6 is held and is integrally formed with the sheet material 5. At that time, the posts 3 at the corners closer to the front surface of the image forming apparatus CP are set up on the pallet 2. FIG. 4 illustrates this state.

(6) In the state illustrated in FIG. 4, the ceiling plate 8 is mounted on the upper surfaces of the posts 3. At that time, since the surface plates 7 and 70 are lower than the image forming apparatus CP, the upper surface of the image forming apparatus CP is exposed to outside. Thus, it is possible for an operator to touch the lower surface of the ceiling plate 8 with his or her hand from outside. Therefore, the positioning operation of the ceiling plate 8 which is usually relatively heavy with respect to the posts 3 can be confirmed from outside, and the ceiling plate 8 can be mounted on the posts 3 while supporting the ceiling plate 8 from below. Thus, it is possible to easily mount the ceiling plate 8 to the posts 3 without adopting a difficult or hard posture such as supporting the ceiling plate 8 from above.

When the image forming apparatus CP is to be unpacked and unloaded, the leg 70A of the disassembled surface plate 70 is allowed to stand, and the surface plate 70 can be used as the slop plate SP as shown in FIG. 5. Thus, when the image forming apparatus CP has the casters, the image forming apparatus CP can be allowed to move without holding the image forming apparatus CP. With this configuration, labor required for unloading can be reduced. Especially when the surface plate is used as the slop plate SP, the slop plate SP may be deformed by the weight of the image forming apparatus CP applied to the upper surface of the slop plate SP or may be bent in extreme cases. However, since the leg 70A functions as a supporting section, the slop plate SP can be prevented from being damaged. Thus, even if the thickness of the surface plate 70 is slightly reduced, the surface plate 70 can effectively be used as the slop plate SP.

According to the first and the second aspects of the invention, the article can be fixed only by pulling out the article-fixing member which is previously accommodated in the pallet on which the article to be packed can be placed. Especially in the second aspect of the invention, since the article-fixing member is wound in the vertical direction, the article can be pushed in the vertical direction, thereby fixing the article, and the article is prevented from falling. With this feature, the article can be fixed and the packing operation can be completed only by using the member provided in the pallet without preparing a member used for fixing the article.

According to the third and the fourth aspects of the invention, the article has a ceiling plate which can open and close. In the fourth aspect, when the article is an image forming apparatus having an automatic document feeder which corresponds to the ceiling plate, the article-fixing member is wound around the document table below the automatic document feeder which corresponds to the ceiling plate, the image forming apparatus is fixed, and the automatic document feeder is closed. Unlike the automatic document feeder, the document table having a flat surface with which the article-fixing member easily comes into contact uniformly when the article-fixing member is wound is used. Thus, force for fixing the article can be applied in a stable state. With this feature, the image forming apparatus can be fixed in a stable state. After the article-fixing member is wound around the document table, the automatic document feeder is closed. Thus, excessive load is not occurred in the automatic document feeder, and the automatic document feeder can be prevented from being damaged.

According to the fifth aspect of the invention, the document table below the automatic document feeder, the document table below the automatic document feeder is provided with the sheet material whose area covering the document table can be changed, and the article-fixing member is wound around the upper surface of the sheet material. Thus, the document table is prevented from being damaged. An upper portion of the automatic document feeder which is closed toward the document table is covered with the cover and thus, the automatic document feeder is prevented from being damaged from outside. In addition, the sheet material and the cover are integrally formed together, the automatic document feeder is not opened unintentionally, and the stable packed state can be maintained against vibration or roll at the time of transportation.

According to the sixth and the seventh aspects of the invention, the packing tool includes the pallet on which the article can be placed, the posts standing on corners of the pallet, and an article-fixing member which is previously accommodated in the pallet and which can be pulled out. The seventh aspect includes a structure for adjusting the pulling-amount of the article-fixing member in the accommodating section. The article can be packed on the pallet without preparing the article-fixing member, and since the posts are provided, a different pallet can be planed on the posts. Since it is only necessary to adjust the pulling-out amount of the article-fixing member in accordance with the article size, it is unnecessary to prepare another article-fixing member in accordance with the article size. Thus, the management of members required for packing articles of different sizes can be simplified, and distribution costs can be reduced.

According to the eighth and the ninth aspects of the invention, since the article-fixing member includes bands which can be wound around the article in the vertical direction and the horizontal direction, the tying positions of the bands can be adjusted in the vertical direction and the horizontal direction. With this feature, the tension of the bands can be adjusted and thus, the article can be pushed in the horizontal direction and the vertical direction, a gap between the packing tool and the article is eliminated and thus, it is unnecessary to prepare a cushioning which eliminates the gap.

According to the tenth and the eleventh aspects of the invention, the surface plate can be stretched between the posts, and the surface plate is lower than the article. Therefore, it is possible to visually check the article from outside, it is easy to wind the article-fixing member around the article from outside the packing tool, and the packing operation is facilitated.

According to the twelfth aspect of the invention, one of the surface plates opposed to the back surface of the article is provided with the inserting section of the article-fixing member, the article-fixing member inserted through the inserting section is tied in accordance with the circumference distance of the article and thus, the article can be pushed against the surface plate which is opposed to the back surface. Since the article can be pushed in one horizontal direction on the pallet and can be fixed, the gap between the article and the pallet can be eliminated. With this feature, the cushioning, which is necessary to eliminate a gap when it is occurred, is unnecessary, and the number of parts can be reduced.

According to the thirteenth aspect of the invention, the surface plate is made of synthetic resin, plate metal or plate material, and the surface plate can be press-fitted to the posts or pallet. The article can be fixed only by fitting the surface plate to the posts or pallet. With this feature, since no special procedure is required for the assembling operation, the assembling and disassembling operations of the packing tool can be facilitated.

According to the fourteenth aspect of the invention, when the article is the image forming apparatus having the automatic document feeder which can open and close, the sheet material capable of covering the document table is integrally or slidably provided with the band. Thus, the sheet material can be positioned to align with the position of the document table, and the sheet material is not deviated from the position of the document table. The document table is prevented from being damaged by the stretching force of the band, and the image forming apparatus can be pushed in the vertical direction and fixed.

According to the fifteenth aspect of the invention, the sheet material covering the upper portion of the document table is provided with the tunnel through which the band can be inserted. Thus, the sheet material can move along the band, and the sheet material can be aligned to the document table in accordance with the winding state of the band. With this feature, even if the winding length of the band is changed due to the height of the image forming apparatus, the sheet material covers the document table, the document table is prevented from being exposed and from being damaged. A failed product at the time of packing can be eliminated.

According to the sixteenth aspect of the invention, the sheet material covering the document table and the cover covering the upper portion of the automatic document feeder can be attached to and detached from each other. Thus, if they are attached to each other when the article is packed and transported, the automatic document feeder can be prevented from unintentionally opening, and such a state can be maintained. With this feature, it is possible to reliably prevent the automatic document feeder from being damaged.

According to the seventeenth aspect of the invention, the ceiling plate on which the pallet can be placed can be mounted on the upper surfaces of the posts, the articles can be stuck, and the storing efficiency can be enhanced.

According to the eighteenth and the nineteenth aspects of the invention, the height of the post can be adjusted in accordance with the height of the article. In the nineteenth aspect, the post includes overlapped frames and thus, the height of the post can be adjusted by relatively moving the frames. It is unnecessary to prepare a packing tool which is suitable for the height of the article, the number of parts when the packing tool is stored can be reduced, and distribution costs can be reduced.

According to the twentieth aspect of the invention, one surface plates stretched between the posts has a leg which is connected thereto in a hinged manner so that the leg can fall and stand. If the leg is allowed to stand up, the surface plate can be used as a slop plate. With this feature, a member required when the article is unloaded is previously provided, the number of parts which should be prepared can be reduced, and the management costs can be reduced. When the surface plate is used as the slope plate, the leg functions as a support section that prevents the slope plate from being damaged. Thus, even if the surface plate does not have enough rigidity for the weight of the article to be unloaded, the surface plate can exhibit many functions.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A packing tool comprising:

a pallet on which is placed an article;

an article-fixing member accommodated in an accommodating section provided in the pallet such that the article-fixing member can be pulled out from the accommodating section; and a length of the article-fixing member is adjustable in accordance with a height and a size of the article, and the article-fixing member pushes the article against the pallet in the vertical direction, the length of the article fixing member being adjustable via linear displacement of a spring, wherein the article is an image forming apparatus provided at its upper surface with an automatic document feeder having a document catch tray which can open and close with respect to a document table, and the document catch tray has a shape which stands, a band used as the article-fixing member wraps around the document table, a sheet material for covering the document table is disposed on the document table, the sheet material is provided at its upper surface with a tunnel through which the band can pass, and the sheet material can slide on the band.

2. The packing tool according to claim 1, wherein the sheet material which covers the document table is provided with a joint member which attachably and detachably supports a cover, the cover can cover an upper portion of the automatic document feeder which is put on an upper surface of the sheet material.

3. A packing tool comprising:

a pallet to place an article;

an article-fixing member accommodated in an accommodating section provided in the pallet such that the article-fixing member can be pulled out from the accommodating section;

a plurality of posts mounted on the pallet and extending away from the pallet; and an opening in the accommodating section open in a same direction as the posts extend, wherein a length of the article-fixing member is adjustable in accordance with a height and a size of the article, and the article-fixing member pushes the article against the pallet in a direction opposite to the direction the posts extend in a state where the article is secured to the pallet, and wherein the article-fixing member extends within the accommodating section in the pallet without rolling.

4. A packing tool comprising:

a pallet to place an article;

an article-fixing member accommodated in an accommodating section provided in the pallet such that the article-fixing member can be pulled out from the accommodating section;

a plurality of posts mounted on the pallet and extending away from the pallet; and an opening in the accommodating section open in a same direction as the posts extend, wherein a length of the article-fixing member is adjustable in accordance with a height and a size of the article, and the article-fixing member pushes the article against the pallet in a direction opposite to the direction the posts extend in a state where the article is secured to the pallet, wherein the article-fixing member encircles a support rod.

5. The packing tool according to claim 4, wherein the article-fixing member is configured to move in relation to the support rod from a first state, in which the article-fixing member is retracted into the accommodating section, and a first end of the article-fixing member contacts the support rod, to a second state, in which the article-fixing member is extracted from the accommodating section, and a second end of the article-fixing member opposite the first end contacts the support rod, and the first end of the article-fixing member does not contact the support rod.

6. The packing tool according to claim 1, wherein the spring extends in a direction perpendicular to a passage including an opening through which the article-fixing member extends.

7. The packing tool according to claim 6, further comprising a support rod along which the article-fixing member slides.

* * * * *